US009732712B1

(12) United States Patent
Biel

(10) Patent No.: US 9,732,712 B1
(45) Date of Patent: Aug. 15, 2017

(54) MARINE PROPULSION DEVICE HAVING FLAME ARRESTOR

(71) Applicant: Brunswick Corporation, Lake Forest, IL (US)

(72) Inventor: Michael J. Biel, Beaver Dam, WI (US)

(73) Assignee: Brunswick Corporation, Lake Forest, IL (US)

( * ) Notice: Subject to any disclaimer, the term of this patent is extended or adjusted under 35 U.S.C. 154(b) by 117 days.

(21) Appl. No.: 14/806,747

(22) Filed: Jul. 23, 2015

(51) Int. Cl.
*F02M 35/10* (2006.01)
*F02M 35/16* (2006.01)
*F02B 61/04* (2006.01)

(52) U.S. Cl.
CPC ..... *F02M 35/165* (2013.01); *F02B 61/045* (2013.01)

(58) Field of Classification Search
CPC ..... F02M 35/165; F02B 61/045
USPC ..... 123/184.21–184.61
See application file for complete search history.

(56) References Cited

U.S. PATENT DOCUMENTS 4,108,122 A * 8/1978 Barnard ..... F02D 41/144 123/438
4,893,591 A 1/1990 Nelson
5,357,913 A 10/1994 Okumura et al.
5,709,187 A * 1/1998 Jaeger ..... F02M 35/10019 123/198 D
7,137,378 B1 * 11/2006 Jaeger ..... F02D 9/1035 123/198 D
2013/0012081 A1 * 1/2013 Morota ..... B63H 21/32 440/38

FOREIGN PATENT DOCUMENTS

JP 2005273528 A * 10/2005

* cited by examiner

*Primary Examiner* — Marguerite McMahon
(74) *Attorney, Agent, or Firm* — Andrus Intellectual Property Law, LLP

(57) ABSTRACT

A marine propulsion device has an internal combustion engine; an intake manifold that delivers intake air from an upstream inlet to a downstream outlet for combustion in a plurality of piston-cylinders in the internal combustion engine; and a flame arrestor located in the intake manifold at the upstream inlet.

14 Claims, 2 Drawing Sheets

MARINE PROPULSION DEVICE HAVING FLAME ARRESTOR

FIELD

The present disclosure relates to marine propulsion devices for marine vessels, and more particularly to flame arrestors on internal combustion engines for marine propulsion devices.

BACKGROUND

The following U.S. Patents are incorporated herein by reference, in entirety:

U.S. Pat. No. 4,893,591 discloses a flame arrestor system for use with an internal combustion engine having a plurality of cylinders. Each cylinder has an intake port and means of ignition of combustible mixtures drawn into the cylinder through the intake port, and an intake manifold connecting the intake ports of a plurality of cylinders. The system serves to reduce the possibility of transmission of combustion producing flame from a cylinder into the intake manifold comprising a flame arrestor positioned between the intake manifold and each cylinder intake port. Each flame arrestor permits passage of combustible mixtures therethrough but prohibits the passage of flame therethrough.

U.S. Pat. No. 5,357,913 discloses a pair of embodiments of flame arrester arrangements for marine propulsion engines wherein the flame arrester is positioned vertically above the thermostat housing at one end of the engine and the plenum chamber for the intake manifold is disposed above the exhaust elbow of the engine so as to provide good induction efficiency and compact size.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A marine propulsion device comprises an internal combustion engine; an intake manifold that delivers intake air from an upstream inlet to a downstream outlet for combustion in a plurality of piston-cylinders in the internal combustion engine; and a flame arrestor located in the intake manifold at the upstream inlet.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Through research and development, the present inventor has determined that packaging space is at a premium on marine propulsion devices, for example on sterndrive engines. The present inventor has recognized that a flame arrestor in such devices competes for package space with other engine components. Thus it is desirable to fit the flame arrestor inside a defined engine package space in a manner that does not interfere with the structure of the marine vessel. However the present inventor has further recognized that flame arrestors require a minimum amount of surface area in order to be effective.

Through research and development, the present inventor has determined that it is possible to dispose the flame arrestor in the interior of the intake manifold, downstream of the throttle body. This frees up space upstream of the throttle body, which otherwise traditionally would be occupied by the flame arrestor. With such an arrangement, the inventor has found that additional packaging space advantageously becomes available for other engine components, such as for example an intake air silencer and/or the like.

Figure 1:
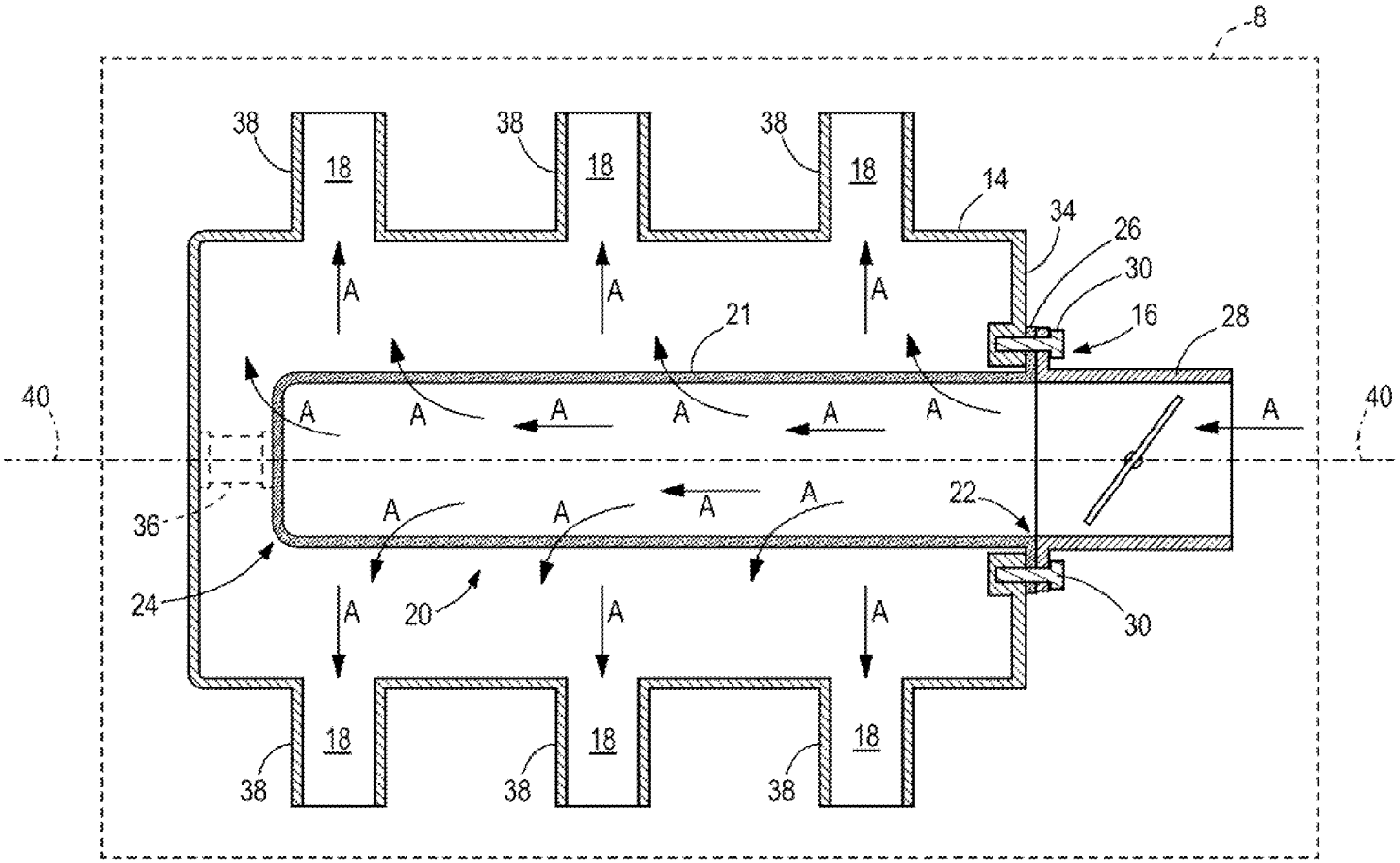
FIG. 1 is a section view of an intake manifold for an internal combustion engine in a marine propulsion device.
Figure 2:
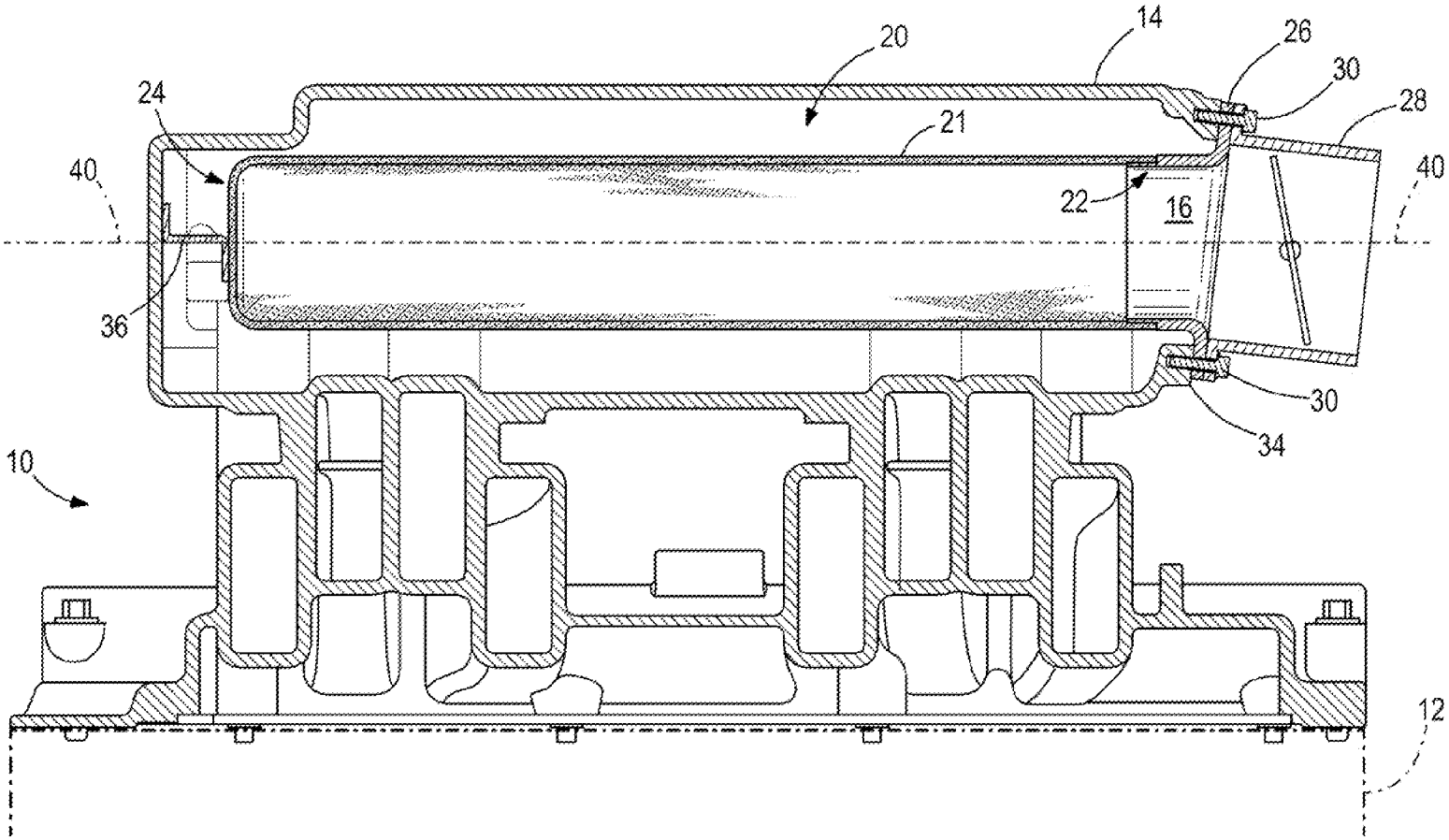
FIG. 2 is another section view of the intake manifold, also showing portions of the internal combustion engine.

FIGS. 1 and 2 depict one example of a marine propulsion device 8 having an internal combustion engine 10. The internal combustion engine 10 includes an engine block 12 and an intake manifold 14 that delivers intake air from an upstream inlet 16 to a plurality of downstream outlets 18 for combustion in a plurality of piston-cylinders in the engine block 12. As shown in FIGS. 1 and 2, a flame arrestor 20 is located in the intake manifold 14 at the upstream inlet 16.

The construction of the flame arrestor 20 can vary from that which is illustrated. In the illustrated example includes a screen mesh similar to the example shown in the above-referenced incorporated U.S. patents. In the illustrated example, the flame arrestor 20 includes an elongated member 21 having a first end 22 coupled to the intake manifold 14 at the upstream inlet 16 and a second end 24 that extends into the intake manifold 14 from the upstream inlet 16. The flame arrestor 20 extends through the upstream inlet 16 such that intake air that flows to the engine block 12 must flow through the flame arrestor 20, as shown at arrows A. In the illustrated example, the first end 22 of the flame arrestor 20 includes an outwardly-extending radial flange 26. The radial flange 26 is axially sandwiched between a throttle body 28 for the internal combustion engine 10 and the intake manifold 14. A plurality of removable fasteners 30 fasten the flame arrestor 20 to the intake manifold 14. The fasteners 30 extend through a radial flange 32 on the throttle body 28, the radial flange 26 on the flame arrestor 20, and into a mounting surface 34 on the intake manifold 14.

An optional stabilizing member 36 stabilizes the second end 24 of the elongated member 21 within the intake manifold 14. The construction and number of stabilizing members can vary from that which is shown. In the illustrated example, the stabilizing member 36 includes a bracket that connects the second end 24 of the elongated body to the interior surface of the intake manifold 14. However it will be understood by those having ordinary skill in the art that additional and/or alternate stabilizing members can be provided at the second end 22 and/or along the length of the elongated member 21 between the first and second ends 22, 24.

As shown in FIG. 1, the intake manifold 14 has a plurality of intake ports 38 that laterally extend from the intake manifold 14. As shown in FIG. 1, the flame arrestor 20 axially extends past the plurality of intake ports 38 such that a substantially uniform flow of intake air is provided to the plurality of intake ports 38. That is, the second end 24 of the elongated member 21 is located on the opposite side of the entire plurality of intake ports 38 with respect to the first end 22 of the elongated member 21.

Thus the present disclosure provides a unique combination including an internal combustion engine 10 for a marine propulsion device 8 that comprises an engine block 12 having a plurality of piston-cylinders, an intake manifold 14 that supplies intake air for combustion in the engine block 12, and a flame arrestor 20 disposed in the intake manifold 14. The flame arrestor 20 is configured to prevent ignition of a combustible mixture of air and fuel in the intake manifold 14, as described in the above-referenced incorporated U.S. patents. The intake manifold 14 has an upstream inlet 16 that receives intake air from a throttle body 28 and a plurality of downstream outlets 18 that discharge intake air to the plurality of piston-cylinders via the plurality of intake ports 38. The flame arrestor 20 is uniquely disposed on the upstream inlet 16 of the intake manifold 14 and extends into the intake manifold 14 towards the downstream outlets 18.

As shown in FIG. 1, the plurality of downstream outlets 18 radially extend with respect to the elongated body and are disposed between the first and second ends 22, 24 of the elongated body. The downstream outlets 18 are located on radially opposite sides of the elongated body with respect to each other. The flame arrestor 20 extends along an axis 40 from the first end 22 towards the second end 24. The flame arrestor 20 extends past all of the plurality of downstream outlets 18 with respect to the axis 40. The flame arrestor 20 extends through the upstream inlet 16 of the intake manifold 14 such that intake air flows to the engine block 12 via the flame arrestor 20, as shown at arrows A.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A marine propulsion device comprising:

an internal combustion engine;

an intake manifold that delivers intake air from an upstream inlet to a downstream outlet for combustion in a plurality of piston-cylinders in the internal combustion engine;

a flame arrestor located in the intake manifold at the upstream inlet;

wherein the flame arrestor comprises an elongated member having a first end coupled to the intake manifold at the upstream inlet and a second end that extends into the intake manifold; and a throttle body, wherein the first end of the flame arrestor comprises a radial flange that is sandwiched between the throttle body and the intake manifold.

2. The marine propulsion device according to claim 1, further comprising a stabilizing member that stabilizes the second end of the elongated member within the intake manifold.

3. The marine propulsion device according to claim 2, wherein the stabilizing member comprises a bracket.

4. A marine propulsion device comprising:

an internal combustion engine;

an intake manifold that delivers intake air from an upstream inlet to a downstream outlet for combustion in a plurality of piston-cylinders in the internal combustion engine;

a flame arrestor located in the intake manifold at the upstream inlet;

wherein the flame arrestor comprises an elongated member having a first end coupled to the intake manifold at the upstream inlet and a second end that extends into the intake manifold;

wherein the flame arrestor extends through the upstream inlet of the intake manifold such that intake air flows to the internal combustion engine via the flame arrestor; and a plurality of intake ports that laterally extend from the intake manifold, wherein the flame arrestor axially extends past the plurality of intake ports such that a substantially uniform flow of intake air is provided to the plurality of intake ports.

5. The marine propulsion device according to claim 4, further comprising a plurality of removable fasteners that fasten the flame arrestor to the intake manifold.

6. The marine propulsion device according to claim 4, wherein the flame arrestor comprises a screen mesh.

7. A marine propulsion device, comprising:

an internal combustion engine having a plurality of piston-cylinders;

an intake manifold that supplies intake air for combustion in the internal combustion engine; and a flame arrestor disposed in the intake manifold, wherein the flame arrestor is configured to prevent ignition of a combustible mixture of air and fuel in the intake manifold;

wherein the intake manifold comprises an upstream inlet that receives the intake air from a throttle body and a plurality of downstream outlets that discharge the intake air to the plurality of piston-cylinders; and wherein the flame arrestor is disposed on the upstream inlet of the intake manifold and extends into the intake manifold towards the plurality of downstream outlets;

wherein the intake manifold comprises an elongated body, wherein the upstream inlet is located at a first end of the elongated body, and wherein the flame arrestor extends from the first end of the elongated body towards an opposite, second end of the elongated body;

wherein plurality of downstream outlets radially extend with respect to the elongated body, and are disposed between the first and second ends of the elongated body; and wherein the flame arrestor extends along an axis from the first end towards the second end, and wherein the flame arrestor extends past the plurality of downstream outlets with respect to the axis.

8. The marine propulsion device according to claim 7, wherein the plurality of downstream outlets is located on radially opposite sides of the elongated body.

9. The marine propulsion device according to claim 7, further comprising a removable fastener that fastens the flame arrestor to the intake manifold.

10. The marine propulsion device according to claim 9, wherein the flame arrestor extends through the upstream inlet of the intake manifold such that intake air flows to the internal combustion engine via the flame arrestor.

11. A marine propulsion device, comprising:

an internal combustion engine having a plurality of piston-cylinders;

an intake manifold that supplies intake air for combustion in the internal combustion engine;

a flame arrestor disposed in the intake manifold, wherein the flame arrestor is configured to prevent ignition of a combustible mixture of air and fuel in the intake manifold;

wherein the intake manifold comprises an upstream inlet that receives the intake air from a throttle body and a plurality of downstream outlets that discharge the intake air to the plurality of piston-cylinders;

wherein the flame arrestor is disposed on the upstream inlet of the intake manifold and extends into the intake manifold towards the plurality of downstream outlets;

a removable fastener that fastens the flame arrestor to the intake manifold;

wherein the flame arrestor extends through the upstream inlet of the intake manifold such that intake air flows to the internal combustion engine via the flame arrestor; and a throttle body, wherein the first end of the flame arrestor comprises a radial flange that is sandwiched between the throttle body and the intake manifold.

12. The marine propulsion device according to claim 11, further comprising a stabilizing member that stabilizes the second end of the elongated member within the intake manifold.

13. The marine propulsion device according to claim 12, wherein the stabilizing member comprises a bracket.

14. The marine propulsion device according to claim 13, wherein the flame arrestor comprises a screen mesh.

* * * * *